FIP7912 XR 4,079,783

United States Patent [19]

Snavely et al.

[11] 4,079,783

[45] Mar. 21, 1978

[54] METHOD OF TREATING FORMATION TO REMOVE AMMONIUM IONS

[75] Inventors: Earl S. Snavely, Arlington; Herbert P. Singleton, Irving, both of Tex.

[73] Assignee: Mobil Oil Corporation, New York, N.Y.

[21] Appl. No.: 781,242

[22] Filed: Mar. 25, 1977

[51] Int. Cl.[2] ..... E21B 43/22

[52] U.S. Cl. ..... 166/252; 166/270; 166/273; 166/305 R; 299/4

[58] Field of Search ..... 166/252, 270, 271, 273, 166/274, 275, 305 R, 307; 175/64; 299/4, 5

[56] References Cited

U.S. PATENT DOCUMENTS

| | | | |
|---|---|---|---|
| 2,161,085 | 6/1939 | Phalen | 166/307 X |
| 3,087,539 | 4/1963 | Maurer, Jr. | 166/275 X |
| 3,203,480 | 8/1965 | Froning | 166/274 X |
| 3,379,249 | 4/1968 | Gilchrist et al. | 166/270 |
| 4,031,959 | 6/1977 | Henderson | 166/307 |

*Primary Examiner*—Stephen J. Novosad
*Assistant Examiner*—George A. Suchfield
*Attorney, Agent, or Firm*—C. A. Huggett; Drude Faulconer

[57] ABSTRACT

A method of treating a subterranean formation which has undergone an in situ leaching operation which utilized an ammonium carbonate and/or bicarbonate lixiviant. In such a leach operation, ammonium ions will absorb onto the clay in the formation and will present a threat of contamination to any ground waters that may be present in the formation. The present method involves flushing the formation with a strong, basic solution, e.g., sodium or calcium hydroxide, to convert the ammonium ions to ammonia which is easily carried from the formation by the basic solution. After substantially all of the ammonium ions are removed, the formation is then flushed with water to remove any basic solution which may remain in the formation.

8 Claims, 1 Drawing Figure

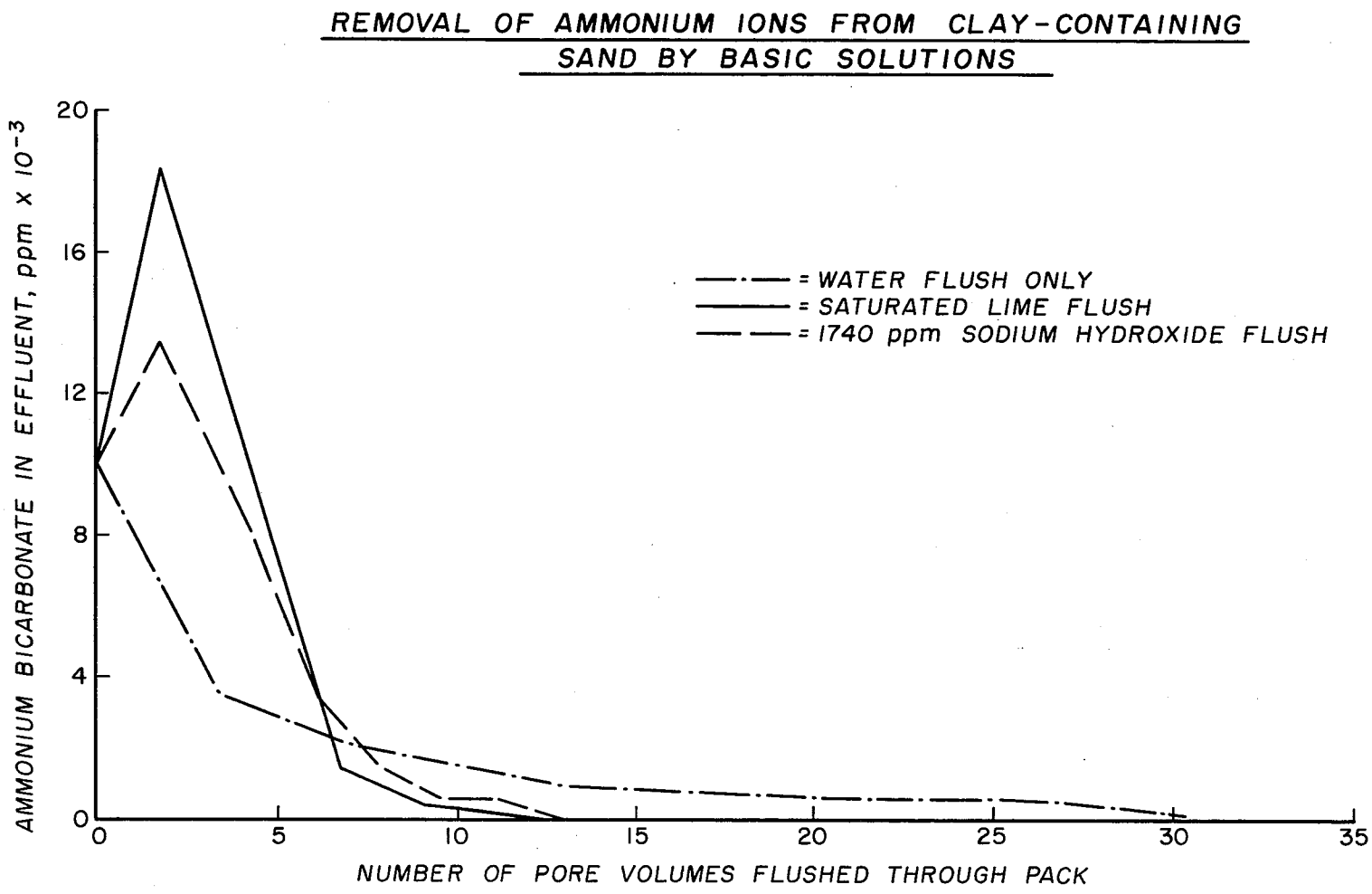
REMOVAL OF AMMONIUM IONS FROM CLAY-CONTAINING SAND BY BASIC SOLUTIONS
= WATER FLUSH ONLY
= SATURATED LIME FLUSH
= 1740 ppm SODIUM HYDROXIDE FLUSH
AMMONIUM BICARBONATE IN EFFLUENT, ppm x 10⁻³
0
4
8
12
16
20
0
5
10
15
20
25
30
35
NUMBER OF PORE VOLUMES FLUSHED THROUGH PACK

METHOD OF TREATING FORMATION TO REMOVE AMMONIUM IONS

BACKGROUND OF THE INVENTION

The present invention relates to a method for restoring a subterranean formation which may have become contaminated during an in situ leach operation and more particularly relates to a method of removing contaminants from a formation after an in situ leach operation to restore the purity of any ground waters that may be present in the formation.

In a typical in situ leach operation, wells are completed into a mineral or metal value bearing (e.g., uranium) formation and a lixiviant is flowed between wells to dissolve the desired values into the lixiviant. The pregnant lixiviant is produced to the surface where it is treated to recover the desired values from the lixiviant. Unfortunately, many known, highly effective lixiviants not only leach the desired values from the formation but, also, they react with certain formations to give up chemical substances which remain in the formation after the lixiviants pass therethrough. Where the formation also contains ground waters and/or a water source which would otherwise be fit for human/and or animal consumption, these chemical substances will likely create a substantial contamination problem for this water. If this be the case, the formation must be treated after a leach operation to remove these contaminants to restore the purity of the water.

One method for improving the purity of a contaminated water source is to merely pump the water from the formation until the contaminant reaches an acceptably low level. Another simple method is to pump uncontaminated water through the formation to flush out the contaminants. These methods work well where the contaminants are soluble and are not absorbed by some component of the formation from which it can only be released at a very slow rate. If the contaminants are absorbed by the formation, extremely large volumes of water must be used to adequately restore the formation.

In many known uranium and related value bearing formations, a substantial part of the formation matrix is comprised of calcium-based clays (e.g., smectite). This type formation presents a real formation water contamination problem when a known, highly effective lixiviant comprised of an aqueous solution of ammonium carbonate and/or bicarbonate is used to leach the desired values from the formation. Here, the ammonium ions from the lixiviant are strongly absorbed by the clays in the formation which makes their removal by flushing with fresh water a very slow and extended process.

SUMMARY OF THE INVENTION

The present invention provides a method of removing a contaminant, i.e., ammonium ions ($NH_4^+$), from a formation containing clay. Specifically, the formation is treated with an aqueous solution of a strong, soluble, basic compound which converts ammonium ions to an un-ionized form, i.e., ammonia ($NH_3$), which can easily be flushed from the formation.

In leaching a formation containing clay with an ammonium carbonate and/or bicarbonate lixiviant, ammonium ions are strongly absorbed onto the clay and will slowly desorb into the ground waters in the formation, thereby contaminating same. In accordance with the present invention, after a leach operation has been completed, an aqueous solution of a strong, soluble, basic compound, e.g., sodium hydroxide, is flowed through the formation between the wells previously used during the leach operation. The basic solution contacts the clay as it flows through the formation and converts the ammonium ions absorb on the clays to ammonia which, in turn, is not strongly attracted to the clays. The ammonia will easily dissolve into the basic solution and will be carried thereby from the formation.

The chemical bases used in the present invention are soluble, themselves, and will not be absorbed by the clays during the flushing of the ammonium ions from the formation. This permits any basic solution remaining in the formation after substantially all of the ammonium ions have been removed to be easily displaced from the formation by flowing fresh water therethrough. The actual operation and apparent advantages of the present invention will be better understood by referring to the following detailed description.

BRIEF DESCRIPTION OF THE DRAWINGS

The FIGURE is a graph showing experimental results of ammonium ion removal from a clay-bearing sand in accordance with the present invention.

DESCRIPTION OF THE PREFERRED EMBODIMENTS

In a typical in situ leach operation for recovering uranium and/or related values, wells are completed into a uranium or other value bearing formation and a lixiviant is flowed between the wells. The uranium and/or related values are dissolved into the lixiviant and are produced therewith to the surface where the pregnant lixiviant is treated to recover the desired values. For an example of such a leach operation, see U.S. patent application Ser. No. 712,404, filed Aug. 6, 1976.

In many known formations where an in situ leach such as mentioned above is carried out, a substantial part of the formation matrix is comprised of calcium-based clays (e.g., smectite). When a desired, highly effective lixiviant, i.e., ammonium carbonate and/or bicarbonate, is used in the leach operation, ammonium ions ($NH_4^+$) are strongly absorbed by the clays and remain in the formation after the leach operation is completed. These ammonium ions slowly dissolve into any ground water that may be present in the formation and thereby pose a contamination threat to the water source.

In accordance with the present invention, the contaminated space (a "pore volume") of the formation is flushed with an aqueous solution of a strong, soluble, basic compound to react with the ammonium ions on the clays to convert them to an un-ionized form, i.e., ammonia ($NH_3$). The ammonia is not strongly attracted to the clays and can easily be swept from the formation by the basic solution.

The basic solution is injected into one of the wells previously used in the leach operation and is produced from another until the ammonium ion concentration in the produced fluids drops below an acceptable level. As will be discussed in more detail below, the number of pore volumes of the basic solution required to remove the necessary amount of ammonium ions will be substantially less than would be required if only fresh water were used.

When the ammonium ion concentration in the produced fluids reaches a desired low, the injection of basic solution is stopped and "fresh" water, or the like, is injected to flush the basic solution from the formation.

When the produced fluids indicate that substantially all of the basic solution has been flushed from the formation, injection of water is stopped and the restoration of the formation is completed.

The basic compounds to be used in the present invention are selected on (1) their ability to convert the ammonium ions to ammonia, (2) their solubility in an aqueous solution, (3) their ability not to be absorbed by the clays, and (4) their availability and costs. Preferably, the basic compounds are sodium hydroxide (NaOH) and calcium hydroxide ($Ca(OH)_2$). Other basic compounds that are effective are lithium hydroxides and potassium hydroxides but are less practical due to cost. The function of the basic solutions removing ammonium ions from the clays will be better understood from the following discussion.

Clays are complex compounds comprised of calcium, magnesium, aluminum, silicon and oxygen. They are capable of exchanging calcium ions for other ions in much the same way as do commercial ion exchange resins used for softening water. This property of clays is illustrated by the equation:

$$Ca^{++}\text{-clay} + M^{+} \rightarrow M^{+}\text{-clay} + Ca^{++} \quad (1)$$

where $M^{+}$ is another positive ion.

The ammonium ion ($NH_4^{+}$) is strongly exchanged by clays so that $NH_4^{+}$ is bound into the clay lattice:

$$Ca^{++}\text{-clay} + 2\,NH_4^{+} \rightarrow 2NH_4^{+}\text{-clay} + Ca^{++} \quad (2)$$

The clay and aqueous solution constituting its environment are in equilibrium, i.e., reaction (2) is reversible. If $NH_4^{+}$ in the solution is descreased, $NH_4^{+}$ will come off the clay and the calcium ion ($Ca^{++}$) will go back on. However, the clay-$NH_4^{+}$ equilibrium is such that only a very small amount of $NH_4^{+}$ in solution will maintain a large amount of $NH_4^{+}$ on the clay, i.e., the clay prefers $NH_4^{+}$ to $Ca^{++}$. This is the reason that $NH_4^{+}$ is only very slowly released by flushing with water containing only neutral, dissolved salts.

When the clay is flushed with a basic solution as in accordance with the present invention, the $NH_4^{+}$ comes off readily because the $NH_4^{+}$ in solution is lowered to extremely low concentrations by converting the $NH_4^{+}$ to $NH_3$:

$$NH_4^{+} + OH^{-} \rightarrow NH_3 + H_2O \quad (3)$$

Ammonia ($NH_3$) is not ionized and is therefore not subject to absorption by the clay. The completed removal reaction can now be written as follows:

$$NH_4^{+}\text{-clay} + NaOH \rightarrow Na^{+}\text{-clay} + NH_3 + H_2O \quad (4)$$

when NaOh is used, and:

$$2NH_4^{+}\text{-clay} + Ca(OH)_2 \rightarrow Ca^{++}\text{-clay} + 2NH_3 + 2H_2O \quad (5)$$

when $Ca(OH)_2$ is used.

It can be seen that substantially less volumes of a desired basic solution are required to restore a formation than would be required if only fresh water were used. By handling these smaller volumes of liquids, the time and expense involved in a formation restoration operation are greatly reduced. To further illustrate the invention and to show the substantially smaller volumes of treating liquid required, the following experimental data is set forth.

A sample of a sand mixture was taken from a typical, leached formation. The primary constituents of this sand mixture were silica, clay, and calcium carbonate, with only minor amounts of other mineral being present. The clay (smectite) content was 19%, as determined by sedimentation analysis. A thick-walled, plastic tube having an internal diameter of 2.54 cm and a length of 15.2 cm was packed with 120 grams of this clay bearing sand.

The ends of the packed tube were covered with fine screen and each end of the tube was connected to a separate reservoir through appropriate valving. The packed tube was then evacuated and filled with ground water taken from the same formation as the sand sample. The amount of ground water imbibed by the open pore space (i.e., one pore volume) of the packed sand was measured to be 32 cubic centimeters.

The packed sand in the tube was loaded with ammonium ions by flowing ammonium bicarbonate therethrough. Aliquots of the effluent were analyzed for ammonium ion concentration, and, when the ammonium ion concentration of the effluent equaled that in the inlet solution, the packed sand was judged to be saturated with ammonium ions. The amount of ammonium ions absorbed by a unit weight of sand was calculated by subtracting the total amount of ammonium ions in the effluent from the total amount that was originally present in the influent solution minus 1 pore volume that is retained in the packed sand. It was determined that the capacity of the clay-containing sand to hold ammonium ions was 0.157 milliequivalents of ammonium ions per gram of sand when the influent contained 10,000 ppm of ammonium bicarbonate.

Three different sand packs were prepared as described above. One sand pack was flushed with fresh water; one with a saturated calcium hydroxide solution; and one with an aqueous solution having 1740 ppm sodium hydroxide. The effectiveness of the flushing solution was measured in terms of the number of pore volumes of solution required to achieve a concentration of only 5 ppm of ammonium ions in the effluent, indicating nearly complete removal of ammonium ions from the clay-containing sand. Agreement between the total amount of ammonium ions removed and the ammonium ion capacity of the sand, as measured earlier, verified that the removal of ammonium ions was substantially complete. The results of these three tests are summarized in the graph of the figure.

It can be seen from the graph that both the calcium hydroxide solution and the sodium hydroxide solution effectively remove the ammonium ions from the packed sand after only 12 to 13 pore volumes have passed therethrough, while it takes some 30 plus pore volumes of water to do the same. Also, it should be recognized that, while the calcium hydroxide solution used in these tests was saturated, the sodium hydroxide solution was not. Due to the greater solubility of sodium hydroxide in water, much greater concentrations of sodium hydroxide can be used in basically the same volume of water which can substantially reduce the number of pore volumes of flushing solution required even more.

What is claimed is:

1. A method of treating a subterranean clay-containing formation having ammonium ions absorbed on the clay, the method comprising:

flushing said formation with a basic solution to convert the ammonium ions to ammonia; and removing said ammonia from said formation.

2. The method of claim 1 wherein said basic solution comprises:

an aqueous solution of sodium hydroxide.

3. The method of claim 1 wherein said basic solution comprises:

an aqueous solution of calcium hydroxide.

4. The method of claim 1 including:

flushing said formation with water to remove said strong, basic solution from said formation after substantially all of said ammonium ions have been removed.

5. The method of restoring a subterranean clay-containing formation which has been leached with an ammonium carbonate and/or bicarbonate lixiviant, said formation having at least one injection well and at least one production well, said method comprising:

injecting a basic solution into said formation through said at least one injection well;

flowing said basic solution through said formation to react with the ammonium ions present in said formation to convert said ammonium ions to ammonia which is, in turn, dissolved into said basic solution; and producing said basic solution and dissolved ammonia from said formation through said at least one production well.

6. The method of claim 5 including:

measuring the ammonia concentration in the produced basic solution until it drops below a desired level;

ceasing the injection of said basic solution; and injecting water into said formation through said at least one injection well to flush said basic solution from said formation through said production well.

7. The method of claim 6 wherein said basic solution comprises:

an aqueous solution of sodium hydroxide.

8. The method of claim 6 wherein said basic solution comprises:

an aqueous solution of calcium hydroxide.

* * * * *